US007464760B2

(12) United States Patent
McElhiney

(10) Patent No.: US 7,464,760 B2
(45) Date of Patent: Dec. 16, 2008

(54) INHIBITING RESERVOIR SOURING USING A TREATED INJECTION WATER

(75) Inventor: John E. McElhiney, Grand Lake, CO (US)

(73) Assignee: Marathon Oil Company, Houston, TX (US)

( * ) Notice: Subject to any disclaimer, the term of this patent is extended or adjusted under 35 U.S.C. 154(b) by 245 days.

(21) Appl. No.: 11/377,233

(22) Filed: Mar. 15, 2006

(65) Prior Publication Data

US 2007/0215344 A1 Sep. 20, 2007

(51) Int. Cl.

| | |
|---|---|
| ***E21B 37/06*** | (2006.01) |
| ***E21B 37/00*** | (2006.01) |
| ***E21B 43/22*** | (2006.01) |
| ***E21B 43/16*** | (2006.01) |

(52) U.S. Cl. ..... 166/312; 166/246; 166/268; 166/300; 166/304

(58) Field of Classification Search ..... 166/246, 166/268, 275, 305.1

See application file for complete search history.

(56) References Cited

U.S. PATENT DOCUMENTS

| | | | | |
|---|---|---|---|---|
| 4,723,603 | A | 2/1988 | Plummer | 166/275 |
| 5,026,491 | A * | 6/1991 | Haack et al. | 507/237 |
| 5,496,545 | A | 3/1996 | Holmes-Farley et al. | 166/275 |
| 6,244,346 | B1 * | 6/2001 | Perriello | 166/304 |
| 6,308,778 | B1 * | 10/2001 | Girgis-Ghaly et al. | 166/300 |
| 6,663,778 | B1 * | 12/2003 | Bader | 210/640 |
| 7,066,262 | B2 * | 6/2006 | Funkhouser | 166/300 |
| 2003/0205520 | A1 | 11/2003 | Johnson | 210/321.85 |

OTHER PUBLICATIONS

Herbert, B. N. et al., SPE 13978, "Factors Controlling The Activity of Sulphate-Reducing Bacteria in Reservoirs During Water Injection", 1985.

Benitez-Nelson, C. R., *Earth Science Reviews*, "The biogeochemical cycling of phosphorous marine systems", pp. 109-135, 2000.

Bass, C. et al., *Journal of Offshore Technology*, "Malignant microbes may sour reservoirs", pp. 31-36, May 1993.

Tyrie, J.J. et al., SPE 26700, "Predicted Increase in Gullfaks H2S Production Associated with Injected Sea Water—Application of Biofilm Model", Sep. 1993.

Okabe, S. et al., *Biotechnology and Bioengineering*, vol. 39, "Effects of Temperature and Phosphorous Concentration on Microbial Sulfate Reduction by *Desulfovibrio desulfuricans*", pp. 1031-1042, 1992.

Sunde, E. et al., SPE 25197, "Field-Related Mathematical Model to Predict and Reduce Reservoir Souring", Mar. 1993.

Khatib, Z. I. et al., SPE 38795, "Reservoir Souring: Analysis of Surveys and Experience in Sour Waterfloods", Oct. 1997.

Hitzman, D. O. et al., SPE 37908, "New Technology for Prevention of Sour Oil and Gas", Mar. 1997.

*Focus 99*, "Causes of souring", p. 2, 1999.

Rizk, T. Y. et al., *Corrosion 98*, Paper 287, "The Effect of Desulphated Seawater Injection on Microbiological Hydrogen Sulphide Generation and Implication for Corrosion Control", 1998.

McElhiney, J. E. et al., *Corrosion 2002*, Paper 02028, "Desulphated Seawater and Its Impact on t-SRB Activity: An Alternative Souring Control Methodology", 2002.

McElhiney, J. E. et al., Slide Presentation at Corrosion 2002, Denver, CO, "Desulfated Seawater and Its Impact on T-SRB Activity—An Alternative to Souring Control Methodology", Apr. 2002.

McElhiney, J. E., Slide Presentation at SPE Applied Technology Workshop, Woodlands, TX, "Desulfated Seawater and Its Impact on T-SRB Activity—An Alternative to Souring Control Methodology", Apr. 2004.

SPE 56772, Sturman, P. J. et al., Control of Hydrogen Sulfide in Oil and Gas Wells with Nitrate Injection, Oct. 1999.

Chen, C. I. et al., *Biofouling*, "Characterization of Microbial Souring in Berea-Sand Porous Medium With a North Sea Oil Field Inoculum", pp. 175-186, 1966.

Chen, C. I. et al., *Biotechnology and Bioengineering*, "Kinetic Investigation of Microbial Souring in Media Using Microbial Consortia from Oil Reservoirs", pp. 263-269, 1994.

Reinsel, M. A. et al., *Journal of Chemical and Engineering Data*, "Partition Coefficients for Acetic, Propionic, and Butyric Acids in a Crude Oil System", pp. 513-516, 1994.

Reinsel, M. A. et al., *Journal of Industrial Microbiology*, "Control of Microbial Souring by Nitrate, Nitrite or Glutaraldehyde Injection in a Sandstone Column", pp. 1128-1136, 1996.

McElhiney, J. E. et al., *Oil & Gas Journal*, "Study Examines Sulfate-Reducing Bacteria Activity", 1996.

SPE 93231, Maxwell, S. et al., Souring of Reservoirs by Bacterial Activity During Seawater Waterflooding, Feb. 4, 2005.

* cited by examiner

*Primary Examiner*—Zakiya W. Bates
*Assistant Examiner*—Angela M DiTrani
(74) *Attorney, Agent, or Firm*—Jack E. Ebel; Rodney F. Brown

(57) ABSTRACT

A process for inhibiting souring in a hydrocarbon reservoir provides a feed water including a plurality of phosphorous constituents and having an elevated phosphorous concentration. At least some of the phosphorous constituents are removed from the feed water to produce a treated injection water, which has a reduced phosphorous concentration less than the elevated phosphorous concentration. The treated injection water is injected into the reservoir via a first well and the hydrocarbon is produced from the reservoir via a second well. The process inhibits souring in the reservoir insofar as the treated injection water results in a lower level of souring in the reservoir over time than if the feed water had been injected into the reservoir.

21 Claims, No Drawings

INHIBITING RESERVOIR SOURING USING A TREATED INJECTION WATER

TECHNICAL FIELD

The present invention relates generally to the injection of water into a hydrocarbon reservoir to facilitate the recovery of hydrocarbons from the reservoir, and more particularly to the treatment of the injection water to inhibit reservoir souring.

BACKGROUND OF THE INVENTION

Enhanced oil recovery processes commonly inject water into a subterranean oil reservoir via one or more injection wells to facilitate the recovery of oil from the reservoir via one or more oil production wells. The water can be injected into the reservoir as a waterflood in a secondary oil recovery process. Alternatively, the water can be injected into the reservoir in combination with other components as a miscible or immiscible displacement fluid in a tertiary oil recovery process. Water is also frequently injected into subterranean oil and/or gas reservoirs to maintain reservoir pressure, which facilitates the recovery of oil and/or gas from the reservoir.

Injection water is oftentimes seawater or a produced water, particularly when the injection wells are offshore, because of the low-cost availability of sea water or produced water at offshore locations. Another motivation for using produced water as an injection water at offshore locations is the difficulty in disposing the produced water offshore. In any case, seawater and produced water are generally characterized as brines, having a high ionic content relative to fresh water. For example, the brines are often rich in sodium, chloride, sulfate, magnesium, potassium, and calcium ions, to name a few.

Despite the ready availability of brines as injection water, it has been found that when brines are introduced into a hydrocarbon reservoir certain constituents in the brines, namely sulfate ions, can have significant detrimental operational effects on the injection wells and hydrocarbon production wells and can ultimately diminish the amount or quality of the hydrocarbon product produced from the hydrocarbon production wells. Sulfate ions can form salts in situ when contacted with metal cations such as barium, which are naturally occurring in the reservoir. Barium sulfate salts readily precipitate out of solution under ambient reservoir conditions. The resulting precipitates accumulate as barium sulfate scale in the outlying reservoir and at the well bore of the hydrocarbon production wells. The scale reduces the permeability of the reservoir and reduces the diameter of perforations in well bores, thereby diminishing hydrocarbon recovery from the hydrocarbon production wells. U.S. Pat. No. 4,723,603 to Plummer (the '603 patent), which is incorporated herein by reference, recognizes the debilitating effect of barium sulfate scale build-up in hydrocarbon production well bores and the outlying reservoir and teaches the desirability of treating sulfate-rich brines used as injection water to reduce the sulfate concentration in the brines before injecting them into the reservoir.

It has also been postulated that a significant concentration of sulfate ions in injection water promotes reservoir souring. Reservoir souring is an undesirable phenomenon, whereby reservoirs are initially sweet upon discovery, but turn sour during the course of waterflooding and attendant hydrocarbon production from the reservoir. Souring contaminates the reservoir with hydrogen sulfide gas or other sulfur-containing species and is evidenced by the production of significant quantities of hydrogen sulfide gas along with the desired hydrocarbon fluids from the reservoir via the hydrocarbon production wells. The hydrogen sulfide gas causes a number of undesired consequences at the hydrocarbon production wells, including excessive degradation of the hydrocarbon production well metallurgy and associated production equipment, diminished economic value of the produced hydrocarbon fluids, an environmental hazard to the surroundings, and a health hazard to field personnel.

The hydrogen sulfide is believed to be produced by an anaerobic sulfate reducing bacteria. The sulfate reducing bacteria is often indigenous to the reservoir and is also commonly present in the injection water. Sulfate ions and organic carbon are the primary feed reactants utilized by the sulfate reducing bacteria to produce hydrogen sulfide in situ and as such is termed a bacteria food nutrient herein. The injection water is usually a plentiful source of sulfate ions, while formation water is a plentiful source of organic carbon in the form of naturally-occurring low molecular weight fatty acids. The sulfate reducing bacteria effects reservoir souring by metabolizing the low molecular weight fatty acids in the presence of the sulfate ions, thereby reducing the sulfate to hydrogen sulfide. Stated alternatively, reservoir souring is a reaction carried out by the sulfate reducing bacteria which converts sulfate and organic carbon to hydrogen sulfide and byproducts.

A number of strategies have been employed in the prior art for remediating reservoir souring with limited effectiveness. These prior art strategies have primarily been single pronged attacks against either the sulfate reducing bacteria itself or against a specific food nutrient of the sulfate reducing bacteria. For example, many prior art strategies for remediating reservoir souring have focused on killing the sulfate reducing bacteria in the injection water or within the reservoir. Conventional methods for killing the sulfate reducing bacteria include ultraviolet light, biocides, and chemicals such as acrolein. Other prior art strategies for remediating reservoir souring have focused on limiting the availability of sulfates or organic carbon to the sulfate reducing bacteria.

Killing the sulfate reducing bacteria or restricting reservoir levels of organic carbon have generally been unsuccessful strategies for remediating reservoir souring. In the case of organic carbon, even if the practitioner were to successfully eradicate a targeted source of organic carbon in the reservoir, such as fatty acids, there are usually abundant alternative indigenous sources of organic carbon in the reservoir proximal to the injection wells, such as residual oil, which would alternatively satisfy the needs of the sulfate reducing bacteria proximal to the injection wells.

In the case of the sulfate reducing bacteria, conventional means of eradicating the sulfate reducing bacteria generally kill off some, if not most, of the sulfate reducing bacteria when applied to a reservoir, thereby initially diminishing the sulfate reducing bacteria level in the reservoir. Nevertheless, it is virtually impossible to completely eliminate the sulfate reducing bacteria from the reservoir due to the impracticality of sufficiently contacting the entire sulfate reducing bacteria population in situ. The surviving sulfate reducing bacteria flourish in the post-treatment environment because the sulfate reducing bacteria killed off is a rich food source for the surviving sulfate reducing bacteria. Therefore, the reservoir sulfate reducing bacteria level is rapidly restored after the initial kill and ultimately exceeds pre-treatment reservoir sulfide reducing bacteria levels. As a result, treatments for killing the sulfate reducing bacteria are believed to be a counterproductive means of inhibiting reservoir souring.

The '603 patent shows that specific filtration membranes can effectively reduce the concentration of sulfate ions in injection water, thereby inhibiting barium sulfate scale formation. Of the known filtration membranes used for treating seawater to produce injection water, nanofiltration membranes are often preferred to reverse osmosis membranes, because nanofiltration membranes generally permit a higher passage of sodium chloride than reverse osmosis membranes. Consequently, nanofiltration membranes are advantageously operable at substantially lower pressures than reverse osmosis membranes. Nanofiltration membranes also maintain the ionic strength of the resulting injection water at a relatively high level, which desirably reduces the risk of clay instability and correspondingly reduces the risk of water permeability loss through the porous substrata of the subterranean formation.

Rizk, T. Y. et al., in their paper "The Effect of Desulphated Seawater Injection on Microbial Hydrogen Sulphide Generation and Implication for Corrosion Control", Corrosion 98, Paper No. 287, 1998, speculate that the membrane filtration process of the '603 patent can also inhibit reservoir souring for the same reason, i.e., by reducing the injection water sulfate concentration. However, it remains to be seen whether membrane filtration can reduce the sulfate concentration in the injection water to a level which sufficiently inhibits production of hydrogen sulfide.

Other species, namely phosphates, termed a bacteria population growth nutrient herein, are known to favor growth of bacteria populations, but are not specifically used by the sulfate reducing bacteria to generate hydrogen sulfide in the manner of the above-recited bacteria food nutrients, i.e., sulfates and organic carbon. Therefore, no practical consideration has been given in the prior art to inhibiting reservoir souring by treating an injection water in a manner which actively removes bacteria population growth nutrients from the injection water before displacing the injection water through an injection well bore into a reservoir.

The present invention recognizes a heretofore unrecognized benefit of inhibiting reservoir souring by removing a bacteria population growth nutrient from an injection water before displacing the injection water through an injection well bore into a reservoir. More particularly, the present invention recognizes the benefit of a single prong process for inhibiting reservoir souring which specifically removes phosphorous, in the form of phosphates or otherwise, from an injection water before placing the injection water in a hydrocarbon reservoir. The present invention also recognizes the benefit of a multi-prong process for inhibiting reservoir souring which removes phosphorous, in the form of phosphates or otherwise, in combination with the removal of sulfate reducing bacteria, sulfates or other components which promote reservoir souring from an injection water before placing the injection water in a hydrocarbon reservoir. Accordingly, it is an object of the present invention to provide a treatment process which removes phosphorous, in the form of phosphates or otherwise, from an injection water, thereby sufficiently reducing the phosphorous concentration in the injection water to a level below a threshold level required to generate significant and/or detrimental quantities of hydrogen sulfide. It is another object of the present invention to provide a treatment process which removes phosphorous, in the form of phosphates or otherwise, in combination with sulfate reducing bacteria, sulfates or other components promoting reservoir souring from an injection water, thereby sufficiently reducing the concentrations in the injection water of multiple components promoting reservoir souring to levels below threshold levels required to generate significant and/or detrimental quantities of hydrogen sulfide.

These objects and others are accomplished in accordance with the invention described hereafter.

SUMMARY OF THE INVENTION

The present invention is a process for inhibiting souring in a hydrocarbon reservoir. The process provides a reservoir containing a hydrocarbon and a first well which is in fluid communication with the reservoir. The process further provides a feed water including a plurality of phosphorous constituents. The feed water has an elevated phosphorous concentration, which is preferably greater than about 30 ppb. At least some of the phosphorous constituents are removed from the feed water to produce a treated injection water, which has a reduced phosphorous concentration less than the elevated phosphorous concentration. The reduced phosphorous concentration is preferably less than about 30 ppb.

At least some of the phosphorous constituents in the feed water are preferably included in a phosphate-containing species. As such, the feed water has an elevated phosphate concentration, which is preferably greater than about 90 ppb. The treated injection water has a reduced phosphate concentration, which is preferably less than the elevated phosphate concentration and more preferably less than about 90 ppb.

The process preferably further injects the treated injection water into the reservoir via the first well. The process preferably further provides a second well in fluid communication with the reservoir and the hydrocarbon is produced from the second well. The process inhibits souring in the hydrocarbon reservoir insofar as the feed water results in a higher level of souring when injected into and residing in the reservoir over time, while the treated injection water preferably results in a lower level of souring when injected into and residing in the reservoir over time.

In accordance with an alternate embodiment, the process provides a feed water including a plurality of phosphorous constituents and a sulfate-containing species. The feed water has an elevated phosphorous concentration, which is preferably greater than about 30 ppb, and an elevated sulfate concentration, which is preferably greater than about 100 ppm. At least some of the phosphorous constituents and at least a portion of the sulfate-containing species are removed from the feed water to produce a treated injection water, which has a reduced phosphorous concentration less than the elevated phosphorous concentration and a reduced sulfate concentration less than the elevated sulfate concentration. The reduced phosphorous concentration is preferably less than about 30 ppb and the reduced sulfate concentration is preferably less than about 60 ppm.

In accordance with another alternate embodiment, the process provides a feed water including a plurality of phosphorous constituents and a sulfate reducing bacteria. The feed water has an elevated phosphorous concentration, which is preferably greater than about 30 ppb, and an elevated sulfate reducing bacteria concentration, which is preferably greater than about 1 cfu/l. At least some of the phosphorous constituents and at least a portion of the sulfate reducing bacteria are removed from the feed water to produce a treated injection water, which has a reduced phosphorous concentration less than the elevated phosphorous concentration and a reduced sulfate reducing bacteria concentration less than the elevated sulfate reducing bacteria concentration. The reduced phosphorous concentration is preferably less than about 30 ppb and the reduced sulfate reducing bacteria concentration is preferably less than about 1 cfu/l.

In accordance with yet another alternate embodiment, the process provides a feed water including a plurality of phosphorous constituents, a sulfate-containing species, and a sulfate reducing bacteria. The feed water has an elevated phosphorous concentration, which is preferably greater than about 30 ppb, an elevated sulfate concentration, which is preferably greater than about 100 ppm, and an elevated sulfate reducing bacteria concentration, which is preferably greater than about 1 cfu/l. At least some of the phosphorous constituents and at least a portion of the sulfate-containing species and the sulfate reducing bacteria are removed from the feed water to produce a treated injection water, which has a reduced phosphorous concentration less than the elevated phosphorous concentration, a reduced sulfate concentration less than the elevated sulfate concentration, and a reduced sulfate reducing bacteria concentration less than the elevated sulfate reducing bacteria concentration. The reduced phosphorous concentration is preferably less than about 30 ppb, the reduced sulfate concentration is preferably less than about 100 ppm, and the reduced sulfate reducing bacteria concentration is preferably less than about 1 cfu/l.

The present invention will be further understood from the following detailed description.

DESCRIPTION OF PREFERRED EMBODIMENTS

The process of the present invention is initiated by a preparatory stage, wherein a feed water is provided for treatment. The feed water is an injection water precursor, from which a treated injection water is obtained for injection into a subterranean reservoir. The subterranean reservoir is more specifically characterized as a hydrocarbon reservoir insofar as hydrocarbons are retained in the subterranean reservoir. The hydrocarbons are typically in a fluid state as either oil, natural gas, or a mixture thereof. The hydrocarbon reservoir is contained within a more expansive subterranean formation and is penetrated by at least one injection well for injecting injection fluids into the reservoir and at least one hydrocarbon production well for producing the hydrocarbons from the reservoir. The hydrocarbon production well is either an offshore well or an onshore (i.e., land-based) well and the injection well is likewise either an offshore well or an onshore well. As such, the present process is applicable to offshore hydrocarbon production sites as well as onshore hydrocarbon production sites.

The feed water is an aqueous liquid which contains one or more bacteria population growth nutrients, wherein one of the bacteria population growth nutrients is a phosphate-containing species. The phosphate-containing species is selected from free phosphate ions, molecules including phosphate, complexes including phosphate, and combinations thereof. The phosphate-containing species can be in solution in the feed water and/or can be in particulate form, retained within the feed water by suspension or other means. A bacteria population growth nutrient is defined herein as a composition which promotes growth of bacteria populations by increasing the number of bacteria cells within the bacteria population, but which is not used as a specific reactant by a sulfate reducing bacteria to generate hydrogen sulfide. Additional bacteria population growth nutrients can include dead microorganisms, fragments of microorganisms, and living microorganisms other than the sulfate reducing bacteria.

The bacteria population growth nutrient of the feed water, which is characterized above as a phosphate-containing species, is alternatively characterized as a phosphorous constituent and the feed water is alternatively characterized as an aqueous liquid containing a plurality of phosphorous constituents. A phosphorous constituent is defined herein as a phosphorous atom, radical or ion, which is either free or is bonded, complexed, associated, or otherwise included within essentially any phosphorous-containing species, such as molecules including one or more phosphorous constituents and complexes including one or more phosphorous constituents. As such, it is apparent, that all phosphate-containing species include at least one phosphorous constituent.

In any case, the feed water can optionally contain one or more bacteria food nutrients. A bacteria food nutrient is defined herein as a component which can be converted to hydrogen sulfide gas when acted upon by the bacteria under the appropriate conditions. The bacteria food nutrient is preferably selected from sulfate-containing species, organic carbon-containing species and mixtures thereof. The sulfate-containing species is selected from free sulfate ions, molecules including sulfate, complexes including sulfate and mixtures thereof. Like the phosphate-containing species, the sulfate-containing species can be in solution or in particulate form within the feed water. The organic carbon-containing species is preferably a low molecular weight fatty acid selected from formic acid, acetic acid, propionic acid, butyric acid, and mixtures thereof.

The feed water further optionally contains one or more population strains of bacteria which are collectively characterized herein as a sulfate reducing bacteria (SRB). The sulfate reducing bacteria is an anaerobic bacteria which has the ability to produce hydrogen sulfide from the specific bacteria food nutrients, sulfate and organic carbon. The term bacteria is broadly used herein, except where expressly stated otherwise, to include active bacteria and dormant spores capable of becoming active bacteria in a suitable environment under appropriate conditions.

A preferred feed water is a brine including a phosphate-containing species. A brine is broadly defined herein as an aqueous liquid having a relatively high concentration of dissolved salts. Exemplary brines having utility in the present process include seawater and produced water. A produced water is water produced during the course of performing a hydrocarbon production-related operation. The produced water is obtained from a subterranean formation containing a hydrocarbon reservoir and is typically a formation water or a combination of a formation water and an injection water. In addition to a phosphate-containing species, produced water typically further comprises *inter alia* chloride, sodium, magnesium, calcium, potassium and carbonate ions and one or more organic acids. The seawater typically further comprises *inter alia*chloride, sodium, sulfate, magnesium, calcium, potassium and carbonate ions and the sulfate reducing bacteria.

An alternative feed water is a water including a phosphate-containing species which is obtained from an underground aquifer other than the subterranean formation providing the produced water (i.e., an underground aquifer water) or is obtained from a surface body of water other than the ocean providing the seawater (i.e., a surface water). The underground aquifer water and surface water each typically have a substantially lower ionic strength than seawater. For example, the underground aquifer water typically has a common chloride concentration less than about 500 parts per million by weight (ppm) or even less than about 100 ppm. The underground aquifer water likewise typically has a sulfate concentration less than about 500 parts per million by weight (ppm) or even less than about 100 ppm.

The particular organic acids of interest in the present process are the above-recited low molecular weight fatty acids, which are often, although not necessarily, derived from the microbial breakdown of hydrocarbons in the subterranean formation containing the hydrocarbon reservoir. The in situ conversion of hydrocarbons to fatty acids is performed by a hydrocarbon converting bacteria which is either indigenous to the formation or is artificially introduced to the formation.

The hydrocarbon converting bacteria, unlike the sulfate reducing bacteria, is an aerobic bacteria. The presence of oxygen in the formation promotes the microbial breakdown of hydrocarbons to fatty acids because the hydrocarbon converting bacteria is aerobic. Since fatty acids are an organic carbon-containing species which is a bacteria food nutrient for the anaerobic sulfate reducing bacteria, oxygen indirectly contributes to reservoir souring.

The feed water preferably has an elevated phosphate concentration which is above a predetermined threshold phosphate concentration. The threshold phosphate concentration is defined herein as a minimum phosphate concentration below which it has been discovered in accordance with the present invention that it is not possible to generate significant and/or harmful quantities of hydrogen sulfide in the hydrocarbon reservoir. The threshold phosphate concentration is generally a complex function of many different interrelated factors, such as temperature, pressure and concentrations of other components promoting reservoir souring. However, the present method is preferably practiced when the threshold phosphate concentration is in a range of about 90 to 225 parts per billion by weight (ppb) and more preferably in a range of about 60 to 120 ppb.

The feed water is alternatively characterized as preferably having an elevated phosphorous concentration which is above a predetermined threshold phosphorous concentration. The threshold phosphorous concentration is defined herein as a minimum phosphorous concentration below which it has been discovered in accordance with the present invention that it is not possible to generate significant and/or harmful quantities of hydrogen sulfide in the hydrocarbon reservoir. The threshold phosphorous concentration is generally a complex function of many different interrelated factors, such as temperature, pressure and concentrations of other components promoting reservoir souring. However, the present method is preferably practiced when the threshold phosphorous concentration is in a range of about 20 to 90 parts per billion by weight (ppb) and more preferably in a range of about 20 to 40 ppb.

After the preparatory stage, the process proceeds to a removal stage, wherein at least some of the phosphate-containing species are removed from the feed water to obtain a treated injection water which is suitable for injection into the hydrocarbon reservoir. In particular, the removal stage preferably comprises removing sufficient amount of the phosphate-containing species from the feed water to reduce the elevated phosphate concentration in the feed water to a reduced phosphate concentration in the resulting treated injection water, which is below the threshold phosphate concentration. As such, the elevated phosphate concentration in the feed water is preferably at least about 90 ppb, more preferably at least about 150 ppb, and most preferably at least about 225 ppb.

The reduced phosphate concentration in the resulting treated injection water is preferably less than about 90 ppb, more preferably less than about 60 ppb, and most preferably less than about 30 ppb. An alternative expression characterizing the effectiveness of the removal stage is the fraction of total phosphate removal which is defined by the fractional difference between the levels of phosphate in the feed water and the treated injection water. A preferred fraction of total phosphate removal is about 20%, more preferably about 50%, and most preferably about 90%.

The removal stage is alternatively characterized as removing at least some of the plurality of phosphorous constituents from the feed water to obtain the treated injection water. In particular, the removal stage preferably comprises removing sufficient amount of the phosphorous constituents from the feed water to reduce the elevated phosphorous concentration in the feed water to a reduced phosphorous concentration in the resulting treated injection water, which is below the threshold phosphorous concentration. As such, the elevated phosphorous concentration in the feed water is preferably at least about 30 ppb, more preferably at least about 50 ppb, and most preferably at least about 75 ppb.

The reduced phosphorous concentration in the resulting treated injection water is preferably less than about 30 ppb, more preferably less than about 20 ppb, and most preferably less than about 10 ppb. An alternative expression characterizing the effectiveness of the removal stage is the fraction of total phosphorous removal which is defined by the fractional difference between the levels of phosphorous in the feed water and the treated injection water. A preferred fraction of total phosphorous removal is about 20%, more preferably about 50%, and most preferably about 90%.

When the feed water includes a sulfate-containing species, the removal stage optionally further comprises removing sufficient amount of the sulfate-containing species from the feed water to reduce the sulfate concentration in the feed water from an elevated sulfate concentration which exceeds a predetermined threshold sulfate concentration to a reduced sulfate concentration in the resulting treated injection water which is less than the threshold sulfate concentration. The threshold sulfate concentration is predetermined in accordance with the present invention as a sulfate concentration below which the generation of significant and/or harmful quantities of hydrogen sulfide in the hydrocarbon reservoir is no longer promoted by injection of the treated injection water into the hydrocarbon reservoir.

The threshold sulfate concentration is generally a complex function of many different interrelated factors. However, the present method is preferably practiced when the threshold sulfate concentration is in a range of about 10 to 500 ppm. As such, the elevated sulfate concentration in the feed water is preferably at least about 100 ppm, more preferably at least about 500 ppm, still more preferably at least about 1000 ppm, and most preferably at least about 3500 ppm. The reduced sulfate concentration in the resulting treated injection water is preferably less than about 60 ppm, more preferably less than about 20 ppm, and most preferably less than about 5 ppm. An alternative expression characterizing the effectiveness of the removal stage is the fraction of total sulfate removal which is defined by the fractional difference between the levels of sulfate in the feed water and the treated injection water. A preferred fraction of total sulfate removal is about 95%, more preferably about 99%, and most preferably about 99.9%.

When the feed water includes an organic carbon-containing species, the removal stage optionally further comprises removing sufficient amount of the organic carbon-containing species from the feed water to reduce the organic carbon concentration in the feed water from an elevated organic carbon concentration which exceeds a predetermined threshold organic carbon concentration to a reduced organic carbon concentration in the resulting treated injection water which is less than the threshold organic carbon concentration. The threshold organic carbon concentration is predetermined in accordance with the present invention as an organic carbon concentration below which the generation of significant and/or harmful quantities of hydrogen sulfide in the hydrocarbon reservoir is no longer promoted by injection of the treated injection water into the hydrocarbon reservoir.

The threshold organic carbon concentration is generally a complex function of many different interrelated factors.

However, the present method is preferably practiced when the threshold organic carbon concentration is in a range of about 10 to 100 ppm. As such, the elevated organic carbon concentration in the feed water is preferably at least about 10 ppm, more preferably at least about 500 ppm, and most preferably at least about 2000 ppm. The reduced organic carbon concentration in the resulting treated injection water is preferably less than about 100 ppm, more preferably less than about 20 ppm, and most preferably less than about 1 ppm. An alternative expression characterizing the effectiveness of the removal stage is the fraction of total organic carbon removal which is defined by the fractional difference between the levels of organic carbon in the feed water and the treated injection water. A preferred fraction of total organic carbon removal is about 10%, more preferably about 50%, and most preferably about 90%.

When the feed water includes a sulfate reducing bacteria, the removal stage optionally further comprises removing sufficient sulfate reducing bacteria from the feed water to reduce the sulfate reducing bacteria concentration in the feed water from an elevated sulfate reducing bacteria concentration which exceeds a predetermined threshold sulfate reducing bacteria concentration to a reduced sulfate reducing bacteria concentration in the resulting treated injection water which is less than the threshold sulfate reducing bacteria concentration. The threshold sulfate reducing bacteria concentration is predetermined in accordance with the present invention as a sulfate reducing bacteria concentration below which the generation of significant and/or harmful quantities of hydrogen sulfide in the hydrocarbon reservoir is no longer promoted by injection of the treated injection water into the hydrocarbon reservoir.

The threshold sulfate reducing bacteria concentration is generally a complex function of many different interrelated factors. However, the present method is preferably practiced when the threshold sulfate reducing bacteria concentration is in a range of about 1 to 10 colony forming units per liter (cfu/l). As such, the elevated sulfate reducing bacteria concentration in the feed water is preferably at least about 1 cfu/l, more preferably at least about 100 cfu/l, still more preferably at least about 1,000 cfu/l, and most preferably at least about 10,000 cfu/l. The reduced sulfate reducing bacteria concentration in the resulting treated injection water is preferably less than about 1 cfu/l, more preferably less than about 0.1 cfu/l, and most preferably less than about 0.01 cfu/l. An alternative expression characterizing the effectiveness of the removal stage is the fraction of total sulfate reducing bacteria removal which is defined by the fractional difference between the levels of sulfate reducing bacteria in the feed water and the treated injection water. A preferred fraction of total sulfate reducing bacteria removal is about 99.9%, more preferably about 99.99%, and most preferably about 99.9999%.

When the feed water includes dissolved oxygen, the removal stage optionally further comprises removing sufficient dissolved oxygen from the feed water to reduce the dissolved oxygen concentration in the feed water from an elevated dissolved oxygen concentration which exceeds a predetermined threshold dissolved oxygen concentration to a reduced dissolved oxygen concentration in the resulting treated injection water which is less than the threshold dissolved oxygen concentration. The threshold dissolved oxygen concentration is predetermined in accordance with the present invention as a dissolved oxygen concentration below which the generation of significant and/or harmful quantities of hydrogen sulfide in the hydrocarbon reservoir is no longer promoted by injection of the treated injection water into the hydrocarbon reservoir.

The threshold dissolved oxygen concentration is generally a complex function of many different interrelated factors. However, the present method is preferably practiced when the threshold dissolved oxygen concentration is in a range of about 1 to 1000 ppb. As such, the elevated dissolved oxygen concentration in the feed water is preferably at least about 1 ppm, more preferably at least about 4 ppm, and most preferably at least about 8 ppm. The reduced dissolved oxygen concentration in the resulting treated injection water is preferably less than about 1 ppm, more preferably less than about 100 ppb, and most preferably less than about 1 ppb. An alternative expression characterizing the effectiveness of the removal stage is the fraction of total dissolved oxygen removal which is defined by the fractional difference between the levels of dissolved oxygen in the feed water and the treated injection water. A preferred fraction of total dissolved oxygen removal is about 90%, more preferably 99%, and most preferably 99.99%.

The removal stage of the present process further optionally comprises removal of one or more other components from the feed water in addition to the phosphorous constituents or phosphate-containing species which are known to promote reservoir souring. For example, the removal stage optionally effects removal of one or more of the following components: sulfate-containing species, organic carbon-containing species, sulfate reducing bacteria, and dissolved oxygen. A preferred removal stage employs a membrane separation system by itself or in combination with other known removal equipment or removal techniques to effect the desired removal of select components including the phosphorous constituents or phosphate-containing species from the feed water.

In its most basic form, the membrane separation system consists essentially of at least one separation membrane. Types of separation membranes having utility in the removal stage include reverse osmosis and nanofiltration membranes. The at least one separation membrane is preferably rolled into spiral wound configuration termed a separation module herein. A preferred membrane separation system comprises one or more pressure separation vessels. In the case of multiple separation vessels, the separation vessels are connected in series or in parallel. At least one separation module and preferably a plurality of separation modules (e.g., up to eight separation modules) are commonly loaded in series into each separation vessel.

During operation of the membrane separation system, a feed stream passes across a first side of the separation membrane within the membrane separation system under a separation pressure which separates the feed stream into a permeate stream and a reject stream. In particular, the permeate stream passes through to an opposing second side of the separation membrane while the reject stream remains on the first side of the separation membrane. In the case where multiple separation modules are loaded into a single separation vessel, the reject stream of an upstream separation module preferably becomes the feed stream of the succeeding downstream separation module and the permeate stream is preferably recovered as a treated injection water or is subjected to further treatment.

In accordance with a specific embodiment of the present process, the removal stage conveys a feed stream into a membrane separation system comprising one or more separation membranes which reject phosphate ions. The feed stream is preferably a feed water which includes phosphate ions at an elevated phosphate concentration exceeding the threshold phosphate concentration. Each of the one or more separation membranes is preferably either a reverse osmosis membrane or a nanofiltration membrane. Nanofiltration membranes are defined herein as membranes which pass at least some salts, such as sodium chloride (NaCl), while substantially rejecting the phosphorous constituents or phosphate-containing species.

In any case, the membrane separation system separates the feed stream into a phosphate-lean permeate stream and a phosphate-rich reject stream. The phosphate-lean permeate stream includes a portion of the water from the feed stream, but the phosphate-lean permeate stream has a reduced phosphate concentration relative to the feed stream. The reduced phosphate concentration is preferably less than the threshold phosphate concentration. The phosphate-rich reject stream includes the remainder of the water from the feed stream, but the phosphate-rich reject stream has an increased phosphate concentration relative to the feed stream. The phosphate-rich reject stream may be suitably disposed or used for other applications. All or a portion of the phosphate-rich reject stream may optionally be recycled back to the membrane separation system, mixed with fresh feed water and reconveyed in the feed stream through the membrane separation system.

As noted above, NaCl is known to be a desirable component of an injection water because it renders the injection water non-damaging to the permeability of porous substrata when the injection water is introduced into a subterranean formation. Accordingly, the membrane separation system of the present process optionally maintains a relatively high fraction of total chloride passage from the feed stream into the permeate stream, while still maintaining a satisfactory fraction of total phosphorous or phosphate removal from the feed stream and a reduced phosphorous or phosphate concentration in the permeate stream.

In some cases a single pass configuration of the membrane separation system, with optional recycle of the reject stream as recited above, is sufficient to produce a permeate stream having a phosphorous or phosphate concentration less than the threshold phosphorous or phosphate concentration and optionally having a desired fraction of chloride passage. The resulting permeate stream may be suitable for use as a treated injection water in a manner described below without substantial further treatment. The single pass configuration is particularly applicable to cases where substantially all or most of the phosphorous constituents or phosphate-containing species in the feed stream is in the form of uncomplexed phosphate ions.

Although the removal stage recited above employs membrane separation, it is within the purview of the skilled artisan to provide alternative means for practicing the removal stage which replace membrane separation in its entirety while obtaining essentially the same result. In any case, the removal stage is followed by an injection stage, wherein the treated injection water is injected into the reservoir via the injection well. A hydrocarbon recovery stage follows the injection stage. The hydrocarbon recovery stage comprises displacing the treated injection water in the hydrocarbon reservoir away from the injection well. The treated injection water functions within the hydrocarbon reservoir in accordance with one of several well known alternatives. In particular, the treated injection water functions in the hydrocarbon reservoir as a waterflood for secondary oil recovery, or in combination with other components as a miscible or immiscible displacement fluid for tertiary oil recovery, or as a pressure maintenance fluid for oil and/or gas recovery. In all cases, the treated injection water facilitates the recovery of hydrocarbons from the hydrocarbon reservoir via the hydrocarbon production well which penetrates the hydrocarbon reservoir.

Although the stages of the present process are described above as discrete sequential operations, it is understood that this is only a conceptualized characterization of the chronology of the stages which is offered for purposes of illustration. In practice, the process stages are typically performed in a continuous manner for extended time periods so that there is often a substantial time overlap in the performance of the different stages. Accordingly, one stage does not necessarily begin with the termination of the next preceding stage, nor does one stage necessarily terminate with the beginning of the next succeeding stage.

Practice of the present process provides a number of ancillary benefits in addition to inhibiting reservoir souring. In particular, practice of the present process advantageously enables hydrocarbon production tubing and equipment employed in conjunction with production of hydrocarbons from the hydrocarbon reservoir of interest to be fabricated from standard metallurgy, thereby avoiding the substantial added cost of using specialized souring resistant metallurgy, which must be designed to withstand exposure to hydrogen sulfide and resist corrosion caused thereby. Standard metallurgy is defined herein as grades of metallurgy which satisfy the requirements of Section A.2 of International Standard NACE MR0175/ISO 15156-2:2003(E), "Petroleum and natural gas industries—Materials for use in $H_2S$-containing environments in oil and gas production—Part 2: Cracking-resistant carbon and low alloy steels, and the use of cast irons." Standard metallurgy is preferably grades of metallurgy which are suitable for use in SSC (Sulfide Stress Cracking) Regions 0 and 1, as defined by FIG. 1 (Section 7.2.1.2, p. 9), and more preferably for use in SSC Region 0 ($H_2S$ partial pressure less than 0.3 kPa).

Another ancillary benefit of practicing the present process is the limitation of biofouling. In particular, practice of the present process advantageously limits biofouling of hydrocarbon production and injection equipment and tubing associated with the hydrocarbon reservoir of interest by imposing conditions which inhibit microbial activity.

The present process can additionally provide an economic and environmentally attractive means for minimizing produced water disposal requirements, when the process is optionally integrated into a closed-loop field environment. The closed-loop field environment includes the hydrocarbon reservoir, the hydrocarbon production well, the process unit operations, and the injection well. As such, the present process is optionally practiced in association with overall operation of the closed-loop field environment. In particular, a produced water is obtained from the hydrocarbon reservoir via the hydrocarbon production well and provides a feed water for the preparatory stage of the present process. The produced water is treated in the removal stage of the present process to obtain a treated injection water. The treated injection water is reinjected back into the hydrocarbon reservoir via the injection well in the injection stage of the present process and enables the production of hydrocarbons and produced water in the hydrocarbon recovery stage. As such, essentially all produced water is recycled back to the hydrocarbon reservoir after being treated in the present process.

While the forgoing preferred embodiments of the invention have been described and shown, it is understood that alternatives and modifications, such as those suggested and others, may be made thereto and fall within the scope of the invention.

I claim:

1. A process for inhibiting souring in a hydrocarbon reservoir comprising:

providing a reservoir containing a hydrocarbon and a well in fluid communication with said reservoir;

providing a feed water including a plurality of phosphorous constituents, wherein said feed water has an elevated phosphorous concentration; and removing at least some of said phosphorous constituents from said feed water to produce a treated injection water, wherein said treated injection water has a reduced phosphorous concentration less than said elevated phosphorous concentration.

2. The process of claim 1, wherein said feed water results in a higher level of souring when injected into and residing in said reservoir over time and said treated injection water results in a lower level of souring when injected into and residing in said reservoir over time.

3. The process of claim 1, wherein said elevated phosphorous concentration is greater than about 30 ppb and said reduced phosphorous concentration is less than about 30 ppb.

4. The process of claim 1, wherein said phosphorous constituents are included in a phosphate-containing species, said feed water has an elevated phosphate concentration, and said treated injection water has a reduced phosphate concentration less than said elevated phosphate concentration.

5. The process of claim 4, wherein said elevated phosphate concentration is greater than about 90 ppb and said reduced phosphate concentration is less than about 90 ppb.

6. The process of claim 1, further comprising injecting said treated injection water into said reservoir via said well.

7. The process of claim 1, wherein said well is a first well, the process further comprising providing a second well in fluid communication with said reservoir, injecting said treated injection water into said reservoir via said first well, and producing said hydrocarbon from said second well.

8. A process for inhibiting souring in a hydrocarbon reservoir comprising:

providing a reservoir containing a hydrocarbon and a well in fluid communication with said reservoir;

providing a feed water including a plurality of phosphorous constituents and a sulfate-containing species, wherein said feed water has an elevated phosphorous concentration and an elevated sulfate concentration; and removing at least some of said phosphorous constituents and at least a portion of said sulfate-containing species from said feed water to produce a treated injection water, wherein said treated injection water has a reduced phosphorous concentration less than said elevated phosphorous concentration and a reduced sulfate concentration less than said elevated sulfate concentration.

9. The process of claim 8, wherein said elevated phosphorous concentration is greater than about 30 ppb and said reduced phosphorous concentration is less than about 30 ppb.

10. The process of claim 8, wherein said elevated sulfate concentration is greater than about 100 ppm and said reduced sulfate concentration is less than about 100 ppm.

11. The process of claim 8, wherein said phosphorous constituents are included in a phosphate-containing species, said feed water has an elevated phosphate concentration, and said treated injection water has a reduced phosphate concentration less than said elevated phosphate concentration.

12. The process of claim 11, wherein said elevated phosphate concentration is greater than about 90 ppb and said reduced phosphate concentration is less than about 90 ppb.

13. A process for inhibiting souring in a hydrocarbon reservoir comprising:

providing a reservoir containing a hydrocarbon and a well in fluid communication with said reservoir;

providing a feed water including a plurality of phosphorous constituents and a sulfate reducing bacteria, wherein said feed water has an elevated phosphorous concentration and an elevated sulfate reducing bacteria concentration; and removing at least some of said phosphorous constituents and at least a portion of said sulfate reducing bacteria from said feed water to produce a treated injection water, wherein said treated injection water has a reduced phosphate concentration less than said elevated phosphate concentration and a reduced sulfate reducing bacteria concentration less than said elevated sulfate reducing bacteria concentration.

14. The process of claim 13, wherein said elevated phosphorous concentration is greater than about 30 ppb and said reduced phosphorous concentration is less than about 30 ppb.

15. The process of claim 13, wherein said elevated sulfate reducing bacteria concentration is greater than about 1 cfu/l and said reduced sulfate reducing bacteria concentration is less than about 1 cfu/l.

16. The process of claim 13, wherein said phosphorous constituents are included in a phosphate-containing species, said feed water has an elevated phosphate concentration, and said treated injection water has a reduced phosphate concentration less than said elevated phosphate concentration.

17. The process of claim 16, wherein said elevated phosphate concentration is greater than about 90 ppb and said reduced phosphate concentration is less than about 90 ppb.

18. A process for inhibiting souring in a hydrocarbon reservoir comprising:

providing a reservoir containing a hydrocarbon and a well in fluid communication with said reservoir;

providing a feed water including a plurality of phosphorous constituents, a sulfate-containing species, and a sulfate reducing bacteria, wherein said feed water has an elevated phosphate concentration, an elevated sulfate concentration, and an elevated sulfate reducing bacteria concentration; and removing at least some of said phosphorous constituents and at least a portion of said sulfate-containing species and said sulfate reducing bacteria from said feed water to produce a treated injection water, wherein said treated injection water has a reduced phosphorous concentration less than said elevated phosphorous concentration, a reduced sulfate concentration less than said elevated sulfate concentration, and a reduced sulfate reducing bacteria concentration less than said elevated sulfate reducing bacteria concentration.

19. The process of claim 18, wherein said elevated phosphorous concentration is greater than about 30 ppb and said reduced phosphorous concentration is less than about 30 ppb.

20. The process of claim 18, wherein said phosphorous constituents are included in a phosphate-containing species, said feed water has an elevated phosphate concentration, and said treated injection water has a reduced phosphate concentration less than said elevated phosphate concentration.

21. The process of claim 20, wherein said elevated phosphate concentration is greater than about 90 ppb and said reduced phosphate concentration is less than about 90 ppb.

* * * * *